US005894744A

United States Patent [19]

Fabschitz

[11] Patent Number: 5,894,744

[45] Date of Patent: Apr. 20, 1999

[54] SPEED CONTROL APPARATUS FOR YARN WINDING STORAGE DRUM

[76] Inventor: Heinrich Fabschitz, Naringerstrasse, 18b-D-83620, Feldkirchen-Westerham, Germany

[21] Appl. No.: 08/945,938

[22] PCT Filed: May 3, 1996

[86] PCT No.: PCT/EP96/01844

§ 371 Date: Oct. 30, 1997

§ 102(e) Date: Oct. 30, 1997

[87] PCT Pub. No.: WO96/35834

PCT Pub. Date: Nov. 14, 1996

[30] Foreign Application Priority Data

May 8, 1995 [DE] Germany ..... 19516788

[51] Int. Cl.[6] ..... D04B 15/48

[52] U.S. Cl. ..... 66/163; 66/132 R; 66/146; 242/47.01; 250/548; 250/559.4; 139/452

[58] Field of Search ..... 66/132 R, 163, 66/125 R, 146; 242/47.01; 250/227.32, 548, 559.4; 139/452

[56] References Cited

U.S. PATENT DOCUMENTS

| | | | |
|---|---|---|---|
| 3,225,446 | 12/1965 | Sarfati et al. . | |
| 3,670,976 | 6/1972 | Vischiani | 242/47.12 |
| 4,407,336 | 10/1983 | Steiner | 139/452 |
| 4,627,474 | 12/1986 | Tholander | 139/452 |
| 4,653,701 | 3/1987 | Riva | 242/47.01 |
| 4,715,411 | 12/1987 | Van Bogaert et al. | 139/452 |
| 4,865,085 | 9/1989 | Ghiardo | 139/452 |
| 5,247,184 | 9/1993 | Kimbell | 250/561 |

FOREIGN PATENT DOCUMENTS

| | | | |
|---|---|---|---|
| 0192821 | 9/1986 | European Pat. Off. . | |
| 0658507 | 6/1995 | European Pat. Off. . | |
| 1635899 | 4/1970 | Germany . | |
| 4413757 | 10/1994 | Germany . | |
| 2777533 | 11/1994 | United Kingdom | 66/132 R |

*Primary Examiner*—Andy Falik
*Attorney, Agent, or Firm*—Greer, Burns & Crain, Ltd.

[57] ABSTRACT

A rotation speed control apparatus for a yam winding storage drum has a unit for driving the drum, and a scanning device for scanning the quantity of storage windings on the drum which provides signals proportional with the number of the storage windings. The scanning device includes a light source for generating light beams along optical paths guided so as to impact the surface of the storage windings wound on the drum. A plurality of sensors are arranged so as to receive a related light beam along a respective light path with a light intensity varying in proportion with the number of storage windings. A plurality of light guiding blocks are each arranged on a respective one of the optical paths between the storage windings and the sensors.

10 Claims, 3 Drawing Sheets

SPEED CONTROL APPARATUS FOR YARN WINDING STORAGE DRUM

BACKGROUND OF THE INVENTION

The invention relates to an apparatus for the control of the rotational speed of a driving-unit for a yarn windings storage drum, as customarily used with devices for storing and delivering yarns in textile machines.

Such an apparatus is particularly useful for machines, which during the progress of the manufacturing process show continuously or even only intermittently an irregular consumption of yarn, as occurs for instance with knitting or hosiery machines, which inter alia knit special patterns of knitwear or rely on jacquard systems, or operate according to stripe patterns, or with shuttle systems or systems which knit plush. The apparatus is also applicable to straight knitting machines or to looms with so-called thread shots.

It is an object of the invention to eliminate the tension differences which appear in the unwinding of yarn from a yarn bobbin as a consequence of the variation of the bobbin diameter and yarn speed. A further object of the invention is to at least to eliminate or simplify the conventional means for guiding, braking and controlling the yarn to minimize the unwanted yarn tension increasing effect.

By inserting such an apparatus in between the yarn bobbin and the knitting point, it is aimed at obtaining principally a uniform knitwear as to length and knitting quality (for instance the pattern of the stitches) and at obtaining a higher efficiency of the machine as a consequence of less disturbances, for instance caused by yarn breakings.

It is already known in circular knitting machines to rely on the method which provides that all yarns to be processed are supplied through yarn delivery devices, which have additionally the task to stop the machine when a yarn break occurs, so as to avoid or at least to strongly limit the damaging of needles and cylinders which otherwise would inevitably occur. The yarn winding serves here as an additional reserve. However the problems in such circular knitting machines are much simpler, at least with the knitting of so-called straight or approximately straight knitwear, if compared with the requirements existing in a comparable apparatus for supplying the yarn in connection with an irregular, i.e. intermittent, yarn consumption, as occurs in the textile machines of the kind above mentioned.

In such known devices for circular knitting machines, as a consequence of the synchronism between the movement of the machine cylinder and the consumption of the yarn of each single knitting point, it is possible to supply the yarn, through relatively simple mechanical means, in correct quantities. Practically, such yarn supply devices are directly driven, mostly in a synchronous way through a continuously adjustable gear device, which is controlled through a toothed belt or the like by the machine cylinder.

For obvious reasons such a yarn supply device is not applicable to textile machines with an intermittent yarn consumption. The sudden variations of the speeds of the yarn which occur with such machines while the cylinder is per se constantly operated cannot be performed by any yarn bobbin of a conventional yarn supplying device. Accordingly, in this complex field so-called storage drums are used in order to solve the problems which are posed.

Of these so-called yarn storage means, there are at least two main forms: one form provides for a yarn storage drum which is intermittently brought to a standstill, which has a rotating winding means which winds up the yarn on the storage drum; the other form provides only for a rotating storage drum, on which the yarn is wound.

The common feature of such embodiments is the principle of the winding of the yarn on a storage drum, so as to render ready a sufficiently large reserve of yarn, while sensitive means ascertain in due time when the yarn reserve has to be replenished as a consequence of the unwinding requested by the textile machine. A further common feature is the fact that collector-free three-phase electrical motors are provided for their driving, which do not suffer from wear. This also means that as a difference from conventional yarn supplying devices for circular knitting machines, each yarn storage drum needs—in connection with its own driving—specially devised sensitive means, and furthermore there is a need for complex signal processing means with electronic control, in order to achieve a correct working operation.

For easily understandable reasons, the technical effort is thus considerable, if one wants to serve, in a textile machine as for instance a hosiery manufacturing automatic machine, each knitting point individually through a yarn storage means of the above kind. Already the complex mechanical construction above all in relation to yarn storage means with winding elements and standstill storage drum with three-phase motors fed by the main voltage render a correct and above all a convenient application practically impossible, even besides the high costs for installation and getting the main voltage, which such devices imply. Several devices for supplying yarns, with yarn storage means of small constructional requirements are known, such as those disclosed in U.S. Pat. No. 3,225,446 or German Patent B1 1 635 899; however such devices do not offer a real solution in particular for the optimal application in relation to the most differentiated kinds of yarns, as for instance the thinnest synthetic or natural fiber yarns, which include rubber or elastomer yarns on which synthetic or natural fiber yarns are wound around or the newer economically more convenient fiber whirling versions thereof. However also with conventional standard yarns, difficulties appear.

In fact a drawback of the device according to German patent D- PS 1 635 899 resides in the fact that the reserve winding wound on the winding drum always requires a relatively high number of windings before an oscillation of the arms under the action of the total friction resistance of the reserve winding on the winding drum starts to be operational. On the basis of the high total friction resistance which is needed to trigger the mechanical action and to eventually correctly control the driving of the winding drum, one practically always meets with undesirable over or under bobbining of the single windings in the reserve windings, which does not permit a uniform axial unwinding tension of the yarn. Other disadvantages are seen in the bulky construction, with deleterious inertial consequences. A further disadvantage is seen in the fact that the sensitive means to control the bobbin work on an on/off system, which does not permit a synchronous relationship between the unwinding status and the rewinding operation, etc.

A disadvantage of the device according to U.S. Pat. No. 3,225,446 is that the so-called optical electrical control of the reserve quantity is ineffective in practical use, and is biased by any light source, for instance by daylight, artificial illumination, machine illumination etc. or by volatile floating fiber particles, etc.

Other known devices as those taught by German Patent DE 28 49 388 or DE 26 51 857, are also complex and affected by fiber impurities always floating in the related environment.

Further known devices are shown in German published Patent applications DE 40 37 575 A1 and DE 39 04 807 A1, neither of which offer a simple solution to the problem inasmuch as they rely on massive storage drums, with the related problems of driving with collector-free three-phase motors. In fact, the larger the motor, the slower the reaction, and thus the larger the storage drum, and the reserve winding.

Another state-of-the-art device is known from EP-A-0192821.

DE-A-4 413 757 is considered to represent the closest prior art for the method of reflecting light operation, describing an apparatus (2) for controlling the rotation speed of a yarn windings storage drum (9,71), comprising a motor (4,72) for driving the drum; a scanning device (3) sensitive to the quantity of reserve windings (11,54,70) on the drum (9,71), whose sensed signals are processed by a signal processing unit (74) arranged between the scanning device (3) and the motor (4,72), the scanning device comprises a light source (27,45,50,59,85,86), whose optical path (40,60, 63) is guided so as to impact the surface of storage windings (11,54,70) wound on the drum. A plurality of light guiding blocks (33,34) are connected with a related light source (27,43,50,59,85,86) for guiding a related plurality of light paths (40,60,63). A plurality of sensor means (28,44,62,87, 88) are capable of receiving a related light path (42,63). The light guiding blocks and the sensor means are arranged on one side (or the other), in a radial direction, of the storage winding drum in FIG. 1. The light guiding block is provided with light passage preventing means (33) preventing the passage of light except through window means (32,41) facing the portion of the drum on which storage windings (11,54,70) are wound so that contiguous windings form a winding width which is capable of biasing the related light path before it reaches the related sensor means (28,44,62, 87,88) which derives from such so biased light a signal to be processed by the signal processing unit (74), thereby controlling said motor (4,72). An obvious disadvantage of the here described scanning device is the fact that, although the optical path (40,60,63) is guided so as to impact the surface of storage windings (11,54,70) wound on the yarn storage drum (9,71), there is no direct physical contact between the said surface of the storage windings and the light guiding blocks (33,34). Particles of fibres, paraffin, dust and other material which are carried along with the ambient air amongst others and will thus deposit sooner or later on the window means (32,41) of said guiding blocks, and which will result in a malfunction or at least an unproper operation of the device.

SUMMARY OF THE INVENTION

A main object of the invention is to provide a control apparatus which permits a reduction in the yarn reserve, with beneficial consequences on the largeness of the storage drum and of the number of windings. A further object is to reduce the driving mechanism requirements, with beneficial consequences on the energy consumption.

These and further objects of the invention are reached by an apparatus according to the invention as more clearly set forth in claim 1.

BRIEF DESCRIPTION OF THE DRAWINGS

The apparatus according to the invention is more closely disclosed in connection with a number of embodiments thereof, as exemplified in the enclosed drawings, in which.

DESCRIPTION OF THE PREFERRED EMBODIMENTS

Figure 1:
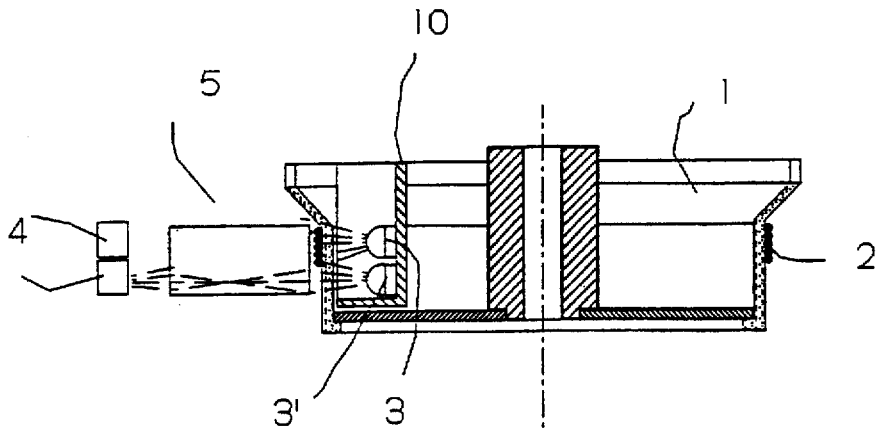
FIG. 1 is a vertical cross section through the storage winding drum, with parts of the control apparatus.
Figure 2:
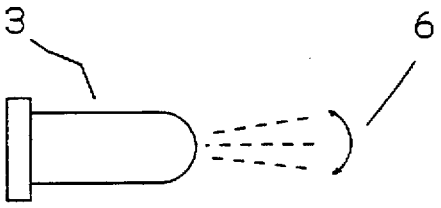
FIG. 2 is a lateral view of a light source, with a limited radiation angle.
Figure 3:
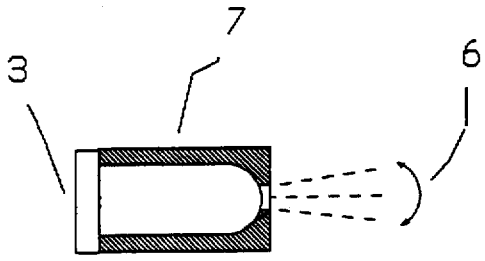
FIG. 3 is a lateral view of a further embodiment with a limited radiation angle.
Figure 4:
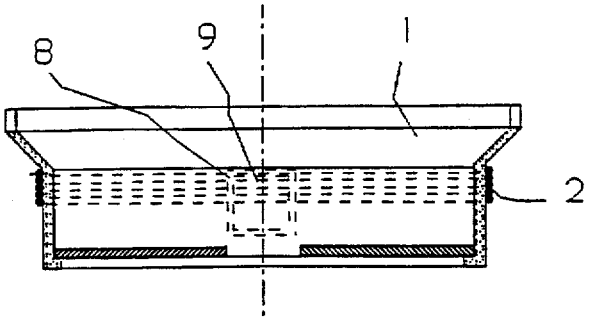
FIG. 4 is a vertical cross section through the storage winding drum with a view of the optical window of the light guiding block.
Figure 5:
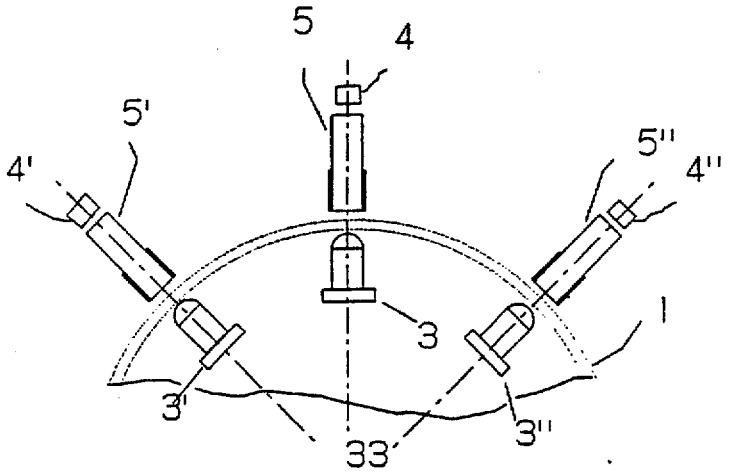
FIG. 5 is a horizontal cross section through the storage winding drum, with a view from above on the optical path.
Figure 6:
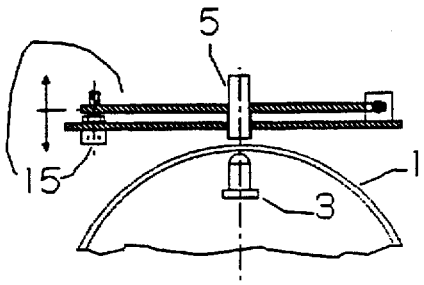
FIG. 6 is a horizontal cross section through the storage winding drum, with a view from above on a movable, adjustable light guiding block.
Figure 7:
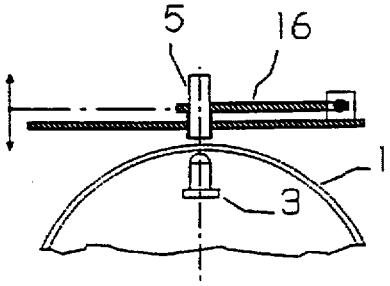
FIG. 7 is a horizontal cross section of the storage winding drum, with a view from above of a spring biased, movable light guiding block.

According to the invention, the apparatus comprises a scanning unit and a signal processing device. The scanning unit comprises a plurality of optical paths 33 generated by a related light source 3. Each of such light sources comprise one or more IR-diodes with a limited radiation angle 6, the light beam of which is directed substantially radially towards the inner side of the storage winding drum 1, which at least on the surface on which the windings 2 rest is transparent to the light. The light sources furthermore comprise a related light sensor 4, which is preferably arranged outside the storage winding drum, as well as a light guiding block 5, which is arranged between the usually available storage winding and the sensor. The task of the light guiding block 5 is to provide—through its light window 9 which is tuned to the maximum width of the storage winding area to be scanned—for the exact optical light conditions (i.e. to exclude stray light, external light, and the like) and above all to keep free the light stroke between the upper surface 2 of the storage winding, which it has to scan, and the sensor 4 from undesirable disturbances, as for instance floating fibers, paraffin deposits and dust. To this end, the light guiding block 5 is provided with a light non transparent cover 10 or a coating 8, enveloping the block on all sides, except for the side permitting the desired light conductive path to progress. It is a principal feature of the invention to mount the light guiding block (5) on a support means which is connected with adjustable means 15 (FIG. 6) or spring means 16 (FIG. 7) so as to be movable in the direction of the light conductive path. More particularly a as shown in FIG. 7, the support means are constituted by flexible leaf springs 16, each supporting a respective one of the light guiding blocks 5. Accordingly, each guiding block is movable against the bias of a leaf spring 16, in a direction away from the drum 1, when a yam with increased thickness or with a knot is wound on the drum 12 under the guiding block 5. This solves the problem otherwise existing that, independently of the variable thickness of the yarn, it is provided for the light window 9 to always be in physical contact with the upper surface of the storage winding 2, which surface is thus constantly and automatically cleaned as a consequence of the rotation of the storage windings.

Figure 11:
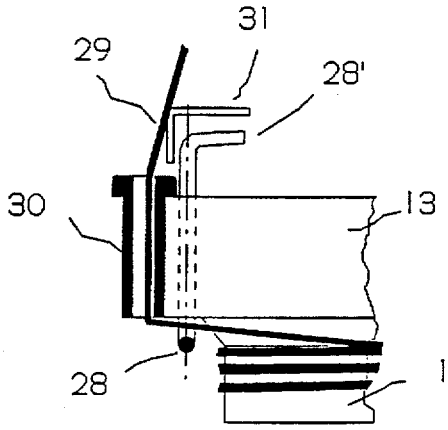
FIG. 11 is a vertical cross section of a part of the storage winding drum, whose securing plate activates the yarn with the storage winding and the mechanical disconnecting device.
Figure 12:
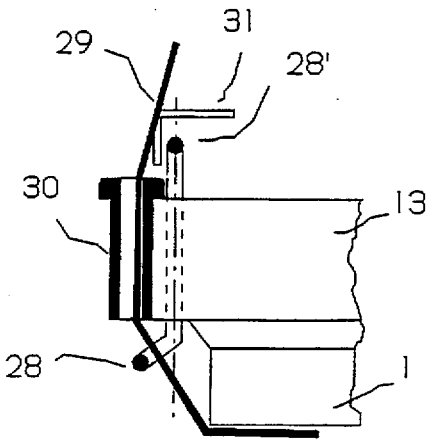
FIG. 12 is a vertical cross section through a part of the device of the storage winding drum, whose securing plate activates the yarn and the mechanical disconnecting device.

The apparatus comprises a mechanical disconnecting device, comprising an oscillating lever member 28' (FIGS. 11 and 12) articulated in 28, and capable of acting on a contact 31 which may disconnect the machine. In fact, if the apparatus is disconnected, or there is a failure, even an electrical one, in the apparatus, such lever member 28' is brought to oscillate by the action of the yarn 29, guided in guide 30, which yarn loosens itself from the drum 1, bringing the lever member to oscillate and act on contact 31.

Figure 8:
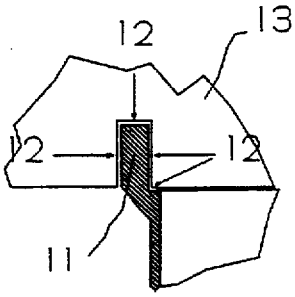
FIG. 8 is a vertical cross section of a part of the cylindrical end of the storage winding drum.
Figure 9:
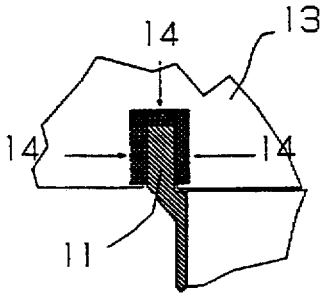
FIG. 9 is a vertical cross section of a further embodiment of the cylindrical end of the storage drum.

The drum 1 is provided (FIGS. 8 and 9) at the side where the yarn is supplied with a cylindrical end 11, and is supported with at least one side exactly in a recess 12 of the lateral support or securing plate 13, preferably lined with a gasket sleeve member .14, for receiving the driving shaft of the trans-parent drum in a manner sufficiently capable of avoiding foreign bodies, which can dirty the optical path 33.

Figure 10:
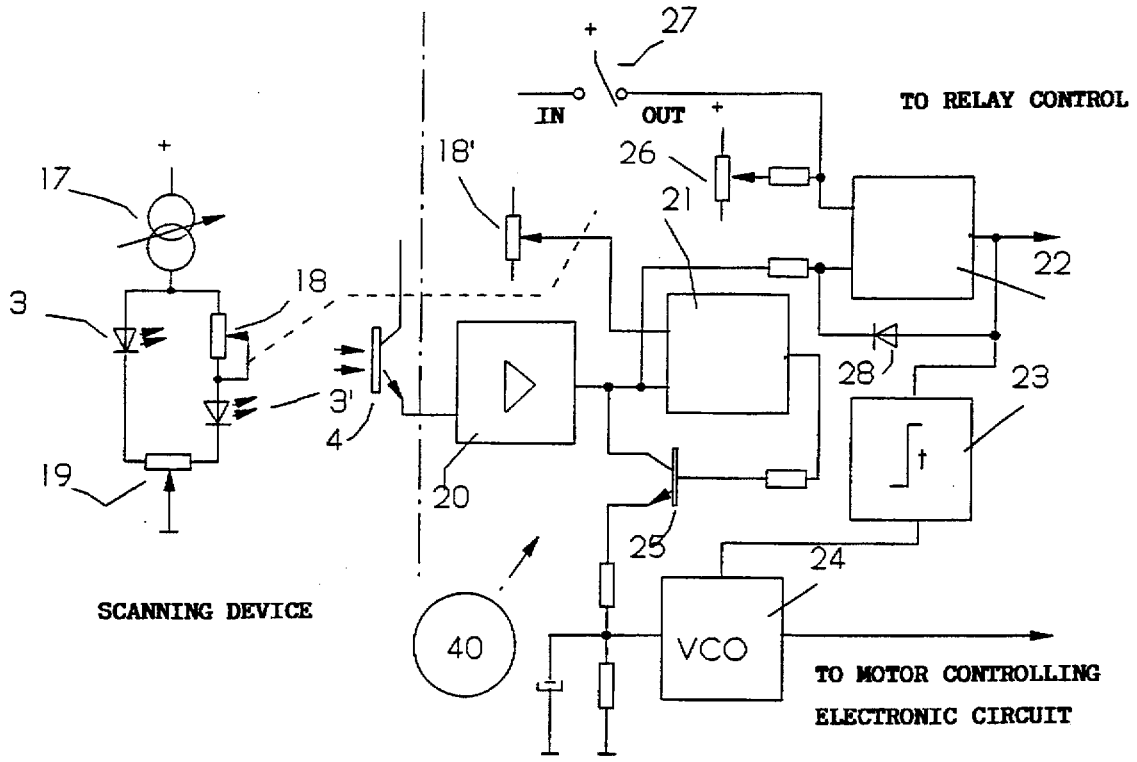
FIG. 10 shows the electronic control apparatus and the signal processing device, in diagrammatical representation.

The electronic circuit is shown in FIG. 10, where the signal processing unit is shown generally by numeral 40. The optical path 33 consists in this example of a light source with two IR-diodes 3, 3' and one sensor 4, in the form of a phototransistor. The two IR diodes 3,3' with the two radiation surfaces 6, which are tuned on the maximum width 2 of the storage windings and on the relatedly dimensioned side of the light window 9 of the light guiding block 5, are fed by a common adjustable electrical current source 17. The adjusting means 19 is providing for adjustment and is preset with the maximum and the minimum width of the storage winding. The adjustment element 18 provides for the possibility of a continuous adjustment between these two end preset values, so that eventually, in case of an empty storage drum even in the event of a displacement of the adjusting element 18, the full preset maximum intensity of the light may come into play in relation to the sensor 4. This maximum value is inter alia used in order to bring about a disconnection of the machine and simultaneously to activate a error signal device, for instance in the form of a signaling light. According to the kind of yarn to be processed, the adjusting means permits it to be adjusted in relation to a width of the windings required for correct operation of the apparatus (with always about ten and up to a maximum of fifteen windings). Four to five windings are needed for the so-called positive operation—a safe transport of the yarn through the storage drum—and the remaining windings operate as reserves in order to cope with an abrupt need for yarn. In case of two few windings the danger appears of an abrupt emptying of the bobbin, while with a larger number of windings, the danger of under or over bobbining occurs, with the consequence that the yarn can longer be unwound in the desired uniform manner from the storage drum.

It is a particular feature of the invention the fact that, since the yarn windings are wound on the drum without interspace, the intensity of the light impacting the sensor always varies in reverse proportion to the number of present windings. The sensor converts the light intensity each time impacting in a corresponding analog signal (many windings=low intensity=small signal; few windings=high intensity=large signal).

Successively to the sensor 4 a signal amplifier and more precisely an impedance converter 20 is connected, which avoids retroactions on the same through the successive signal processing functions. From the same the main signal is led to two comparators 21, 22 and to a transistor 25, which operates like a switch. The comparator 21 compares the level of the main signal with the pre-selected value, which is set through the adjustment of the adjustment member 18', which is positively connected with the adjustment element 18. As already disclosed, the adjusting element 18 presets the effective storage winding width. By means of the simultaneous variation of the nominal (desired) value of the comparator level, for instance by means of an increase, which occurs in relation to a diminishing of the adjustment related to the storage winding width (which may be desired or required by thinner yarn kinds), a higher level of the main signal is required in order to activate the comparator 21 and thus to bring the switch 25 in its conductive position, so that the main signal reaches the input to the voltage/frequency converter 24. In the practical embodiment it has been found that such a double function is indispensable in the adjustment of the width of the storage winding, since otherwise not all the different yarns existing on the market (which differ in thickness, color, structure, etc.) can be correctly processed.

The comparator 22 has the task to survey the level of the main signal and in the case when a certain preset value is exceeded, which generally occurs when the reserve of windings is empty or almost empty, its trigger means 26 has to trigger a failure signal, for instance the switching on of a failure indicating lamp and/or a disconnection relay, which may stop the machine. Simultaneously or with a certain delay, the comparator 22 can, through the timing element 23, disconnect the voltage/frequency converter 24, so that the driving unit of the storage drum does not continue to needlessly operate. The stopping is reached through the diode 40 and the reactivation of the comparator 22 occurs through the switching of the main switch 27. The voltage/frequency converter 24 generates for instance a series of impulses required for a stepping motor, within the framework of a conventional motor control electronic system.

I claim:

1. Apparatus for controlling, as a function of a sensed signal, the rotation speed of a yarn windings storage drum usable with a yarn delivery device in a textile machine, including:

a driving unit for driving said drum;

a scanning device for scanning the quantity of storage windings on the yam windings storage drum and adapted to provide a sensed signal proportional with the number of storage windings; and a signal processing unit arranged between said scanning device and said driving unit for processing said sensed signal and controlling operation of said driving unit; wherein said scanning device comprises:

at least one light source for generating light beams along optical paths guided so as to impact the surface of the storage windings wound on said drum; sensor means for receiving the light beams along a related said light path, after impact with said storage windings, with a light intensity varying in proportion with the number of the storage windings and for converting said varying light intensity into a corresponding analog signal constituting said sensed signal; light guiding blocks being arranged each on a respective one of said optical paths between said storage windings and said sensor means, said light guiding blocks being provided with window means for guiding the light beams along said light paths between the storage windings and said sensor means and keeping said light beams free from any disturbance, wherein said window means are arranged so as to face light transparent portions provided on the drum on which the storage windings are wound, and wherein said scanning device farther comprises support means for supporting said light guiding blocks so as to be movable in the direction of said optical path.

2. Apparatus according to claim 1, wherein said at least one light source comprises at least one IR-diode with a,limited radiation angle for defining a restricted radiation impact area on said drum, the radiation angle of said at least one diode being tuned on the maximum width of the storage windings and on the size of the relative window means.

3. Apparatus according to claim 1, wherein light passage preventing means are formed on said light guiding blocks, said light passage preventing means being constituted by a non transparent cover means applied on said guiding blocks so as to leave uncoated only said window means.

4. Apparatus according to claim 1, wherein said window means are arranged in close relationship with said windings, so as to bring about physical contact therebetween.

5. Apparatus according to claim 1, wherein said scanning device supporting means comprise spring members for biased movement of said light guiding blocks in the direction of said optical path.

6. Apparatus according to claim 1, wherein said scanning device supporting means comprise adjustable means for adjusting movement of said guiding blocks so that said window means are in contact with an upper surface of the storage windings.

7. Apparatus according to claim 1, wherein the signal processing unit comprises adjusting means adapted to set a threshold for starting and stopping said driving unit.

8. Apparatus according to claim 7, comprising an adjusting element for adjusting the radiation of said at least one light source, said adjusting element being positively connected with an adjustment member for controlling said apparatus.

9. Apparatus according to claim 1, further comprising:

a machine disconnecting device including an oscillating disconnection member arranged to cooperate with the yam so as to be sensitive to a position said yam takes up upon disconnection or operation failure of the apparatus, such as a current feeding failure; and a contact, said disconnecting device being adapted to act on said contact for disconnecting the machine.

10. Scanning device for scanning the quantity of storage windings on a yam winding storage drum usable in textile machines, comprising: at least one light source for generating light beams along optical paths guided so as to impact the surface of the storage windings wound on said drum; sensor means for receiving the light beams along a related said light path, after impact with said storage windings, with a light intensity varying in proportion with the number of the storage windings and for converting said varying light intensity into a corresponding analog signal; light guiding blocks being arranged each on a respective one of said optical paths between said storage windings and said sensor means, said light guiding blocks being provided with window means for guiding the light beams along said light paths between the storage windings and said sensor means and keeping said light beams free from any disturbance; and a support means for supporting said light guiding blocks so as to be movable in the direction of said optical path.

* * * * *